US012233349B2

(12) United States Patent
Kernacs et al.

(10) Patent No.: US 12,233,349 B2
(45) Date of Patent: Feb. 25, 2025

(54) OVERHUNG RIDE ASSEMBLY

(71) Applicant: Universal City Studios LLC, Universal City, CA (US)

(72) Inventors: Sandor Kernacs, Gambrills, MD (US); Derek Morris, Perry, UT (US); Trent Bitton, Farr West, UT (US); Trent Deem, Ogden, UT (US); Raleigh Cornwell, Ogden, UT (US); Greg Rude, Manhattan Beach, CA (US); John Stapleton, London (CA)

(73) Assignee: Universal City Studios LLC, Universal City, CA (US)

( * ) Notice: Subject to any disclaimer, the term of this patent is extended or adjusted under 35 U.S.C. 154(b) by 407 days.

(21) Appl. No.: 17/704,273

(22) Filed: Mar. 25, 2022

(65) Prior Publication Data

US 2022/0305395 A1 Sep. 29, 2022

Related U.S. Application Data

(60) Provisional application No. 63/166,130, filed on Mar. 25, 2021.

(51) Int. Cl.
*A63G 31/02* (2006.01)
*A63G 31/16* (2006.01)

(52) U.S. Cl.
CPC ..... *A63G 31/02* (2013.01)

(58) Field of Classification Search
CPC ..... A63G 1/00; A63G 31/00; A63G 31/02; A63G 31/16; A63G 7/00; A63G 25/00
(Continued)

(56) References Cited

U.S. PATENT DOCUMENTS 5,595,121 A 1/1997 Eliott et al.
5,791,254 A 8/1998 Mares et al.
(Continued)

FOREIGN PATENT DOCUMENTS

CN 202751825 U 2/2013
EP 0533326 1/1996
WO 2001008767 2/2001

OTHER PUBLICATIONS

PCT/US2022/021920 Invitation to Pay Additional Fees mailed Jul. 1, 2022.

(Continued)

*Primary Examiner* — Kien T Nguyen
(74) *Attorney, Agent, or Firm* — Fletcher Yoder, PC

(57) ABSTRACT

A ride system includes a track and an overhung ride assembly. The overhung ride assembly includes a transport platform coupled to the track, a ride vehicle, and a heave system extending between the transport platform and the ride vehicle. The heave system is configured to heave the ride vehicle relative to the transport platform. The heave system includes an extendible tube defining a variable volume configured to store a gaseous fluid. The extendible tube is configured to extend in response to a lowering of the ride vehicle away from the transport platform by the heave system such that the gaseous fluid within the variable volume of the extendible tube provides a fluid force that biases the extendible tube toward a contracted configuration to assist the heave system with a lifting of the ride vehicle toward the transport platform.

20 Claims, 5 Drawing Sheets

(58) Field of Classification Search
USPC ..... 472/59–60, 130
See application file for complete search history.

(56) References Cited

U.S. PATENT DOCUMENTS

| | | | | |
|---|---|---|---|---|
| 9,050,896 | B2 | 6/2015 | Brier et al. | |
| 9,457,687 | B2 | 10/2016 | Brier et al. | |
| 10,632,390 | B1 * | 4/2020 | Blum | A63G 31/02 |
| 2010/0062868 | A1 * | 3/2010 | Mordelt | A63G 31/02<br>472/131 |
| 2010/0184524 | A1 | 7/2010 | Lai et al. | |
| 2013/0306389 | A1 | 11/2013 | Penev | |
| 2016/0184719 | A1 * | 6/2016 | D'Andrea | G05B 15/02<br>700/275 |
| 2018/0221778 | A1 | 8/2018 | Blum et al. | |
| 2020/0294401 | A1 * | 9/2020 | Kerecsen | G08G 1/205 |

OTHER PUBLICATIONS

PCT/US2022/021920 International Search Report and Written Opinion mailed Aug. 22, 2022.

* cited by examiner

OVERHUNG RIDE ASSEMBLY

CROSS-REFERENCE TO RELATED APPLICATIONS

This application claims priority from and the benefit of U.S. Provisional Application Ser. No. 63/166,130, entitled "OVERHUNG RIDE ASSEMBLY," filed Mar. 25, 2021, which is hereby incorporated by reference in its entirety for all purposes.

BACKGROUND

This section is intended to introduce the reader to various aspects of art that may be related to various aspects of the present disclosure, which are described and/or claimed below. This discussion is believed to help provide the reader with background information to facilitate a better understanding of the various aspects of the present disclosure. Accordingly, it is understood that these statements are to be read in this light, and not as admissions of prior art.

Theme park or amusement park attractions have become increasingly popular, and have been created to provide guests with unique immersive experiences. Many theme parks or amusement parks include ride systems that move a ride vehicle relative to a track. Certain ride systems may include overhung ride assemblies, meaning a ride vehicle and other aspects of the ride system (e.g., a transport platform, a heave system, a motion base platform) are positioned underneath the track of the ride system relative to a Gravity vector (e.g., while the overhung ride assembly is in a resting or home position). Unfortunately, traditional ride systems employing overhung ride assemblies may include a limited range of motion of the ride vehicles relative to the track. Further, traditional ride systems employing overhung ride assemblies may be expensive to manufacture (e.g., due to excessive part counts and expensive parts) and operate (e.g., due to wasted energy). It is now recognized that improved ride systems employing improved overhung ride assemblies are desired.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a ride system includes a track and an overhung ride assembly. The overhung ride assembly includes a transport platform coupled to the track, a ride vehicle, and a heave system extending between the transport platform and the ride vehicle. The heave system is configured to heave the ride vehicle relative to the transport platform. The heave system includes an extendible tube defining a variable volume configured to store a gaseous fluid. The extendible tube is configured to extend in response to a lowering of the ride vehicle away from the transport platform by the heave system such that the gaseous fluid within the variable volume of the extendible tube enables a fluid force that biases the extendible tube toward a contracted configuration to assist the heave system with a lifting of the ride vehicle toward the transport platform.

In an embodiment, a ride system includes a track and an overhung ride assembly. The overhung ride assembly includes a transport platform coupled to the track, a ride vehicle, and a heave system extending between the transport platform and the ride vehicle. The heave system is configured to heave the ride vehicle relative to the transport platform. The heave system includes a strong arm assembly having a backhoe configuration including a first rigid arm coupled via a first hinge to the ride vehicle or to a motion base platform coupled to the ride vehicle, and including a second rigid arm coupled the first rigid arm via a second hinge and to a transport hinge at the transport platform.

In an embodiment, a ride system includes a track and an overhung ride assembly. The overhung ride assembly includes a transport platform coupled to the track, a ride vehicle, and a heave system configured to heave the ride vehicle relative to the transport platform. The heave system includes a winch assembly having a spool, a cable coupled to the spool, and a motor. The motor is configured to drive the spool into rotation in a first circumferential direction to lift the ride vehicle via the cable toward the transport platform and create potential energy in the ride vehicle. The motor is also configured to generate power in response to the spool rotating in a second circumferential direction opposite to the first circumferential direction as the ride vehicle is lowered via the cable away from the transport platform and the potential energy of the ride vehicle is converted to kinetic energy.

DRAWINGS

These and other features, aspects, and advantages of the present disclosure will become better understood when the following detailed description is read with reference to the accompanying drawings in which like characters represent like parts throughout the drawings, wherein.

Figure 7:
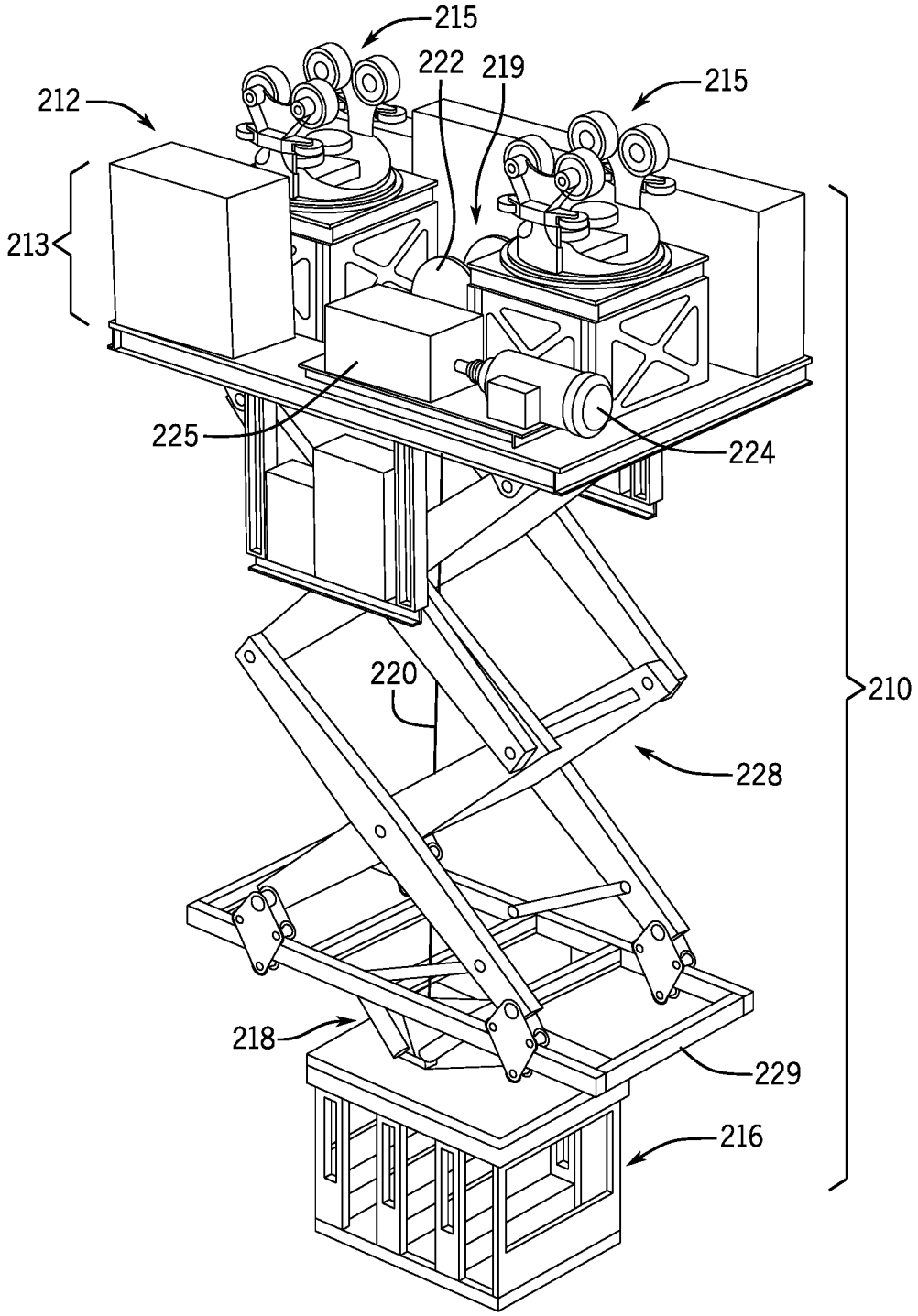
FIG. 7 is a perspective view of an overhung ride assembly for a ride system, where a ride vehicle of the overhung ride assembly is extended away from a transport platform of the overhung ride assembly, in accordance with an aspect of the present disclosure.
Figure 8:
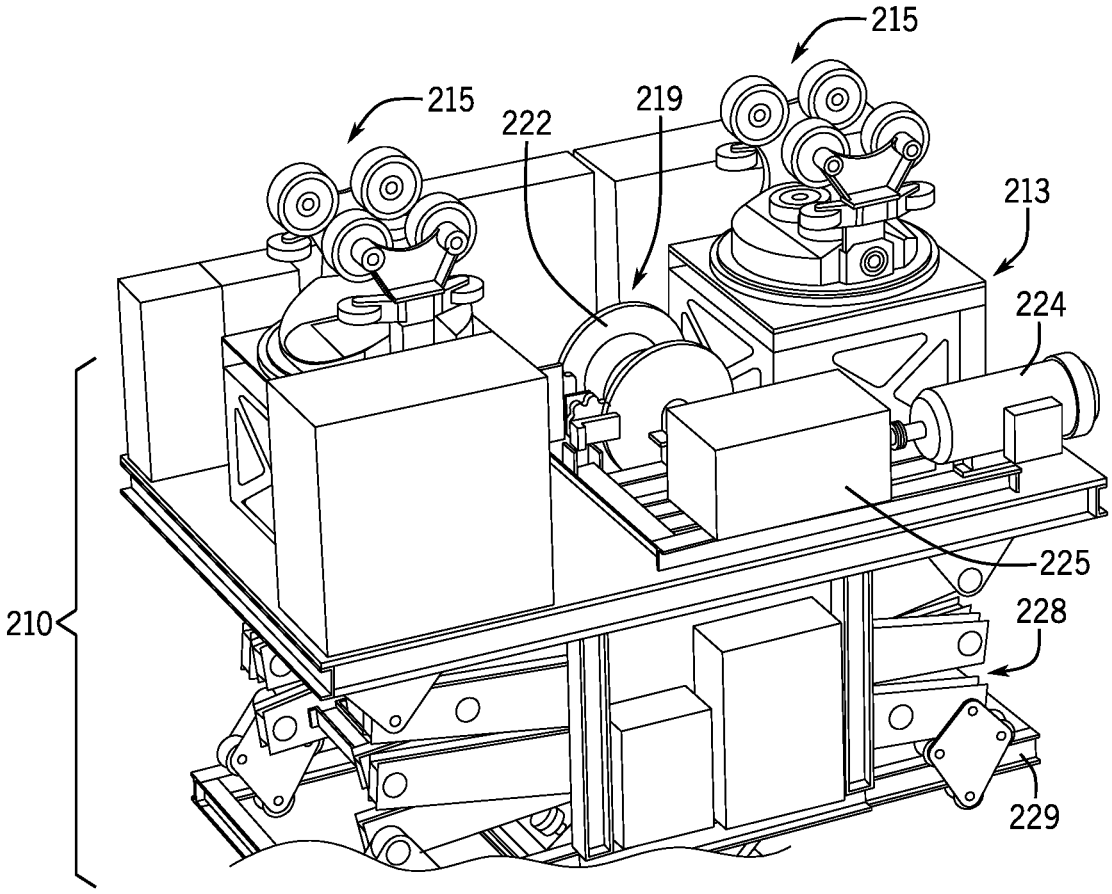
Figure 9:
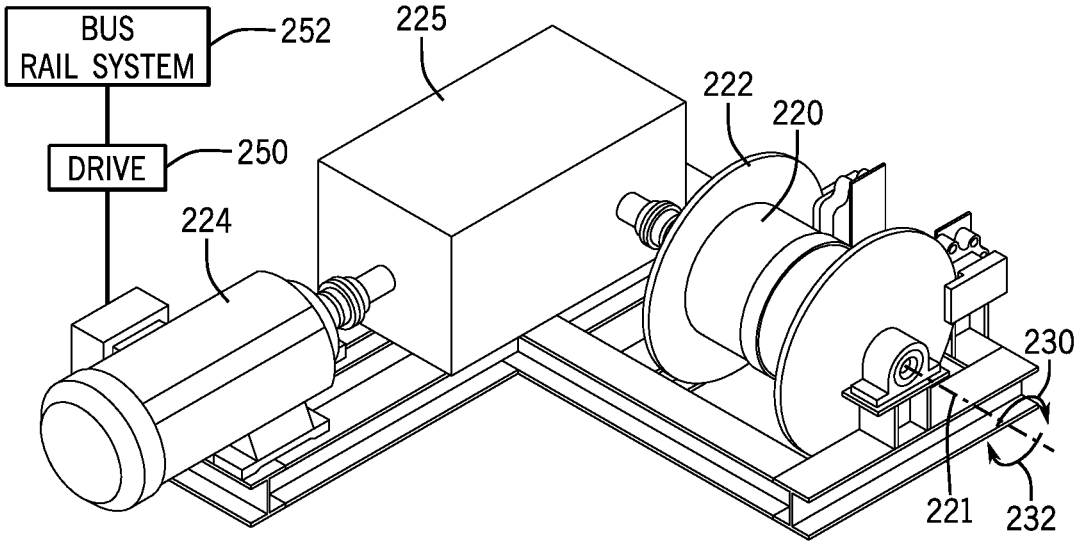

FIG. 8 is a perspective view of the overhung ride assembly of FIG. 7 in which the overhung ride assembly is contracted such that a ride vehicle of the overhung ride assembly is adjacent to a transport platform of the overhung ride assembly, in accordance with an aspect of the present disclosure; and FIG. 9 is a perspective view of a winch assembly for use in the overhung ride assembly of FIG. 7, the winch assembly being configured to lift a ride vehicle of the overhung ride assembly of FIG. 7 and to generate power as the ride vehicle is lowered, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to ride systems having overhung ride assemblies. For example, an overhung ride assembly may include a ride vehicle and other features positioned beneath a track or mount of the ride system relative to a Gravity vector (e.g., while the overhung ride assembly is in a resting or home position). The overhung ride assembly may also include a transport platform connected to the track and configured to move along the track, and one or more motion systems or assemblies (e.g., a heave system and a motion base platform) positioned at the transport platform and/or between the transport platform and the ride vehicle. The one or more motion systems or assemblies may be configured to move the ride vehicle in various directions (e.g., heave, translate, roll, pitch, yaw) relative to the transport platform.

In accordance with an embodiment of the present disclosure, the overhung ride assembly may include a heave system configured to lift and lower the ride vehicle relative to the transport platform, and a motion base platform between the heave system and the ride vehicle. The motion base platform may include, for example, a Stewart platform or an octopod. In general, the motion base platform may roll, pitch, and/or yaw the ride vehicle relative to the heave system and transport platform. In an embodiment of the present disclosure, the ride system may not include the motion base platform, and the heave system may be directly connected to the ride vehicle.

The heave system may include several assemblies that work in conjunction to lift the ride vehicle toward the transport platform and to lower the ride vehicle away from the transport platform. For example, the heave system may include a winch assembly having a spool, a cable that extends from the ride vehicle (or the motion base platform) to the spool, and a motor that turns the spool. The motor may perform work to turn the spool in a first circumferential direction to wind the cable onto the spool and raise the ride vehicle toward the transport platform. The spool may also turn in a second circumferential direction opposite to the first circumferential direction to unwind the cable from the spool and lower the ride vehicle away from the transport platform. In an embodiment of the present disclosure, the spool may receive multiple cables that extend between the transport platform and the ride vehicle or the motion base platform, or multiple cable-dedicated spools may be employed. Further, multiple motors may be employed to drive rotation of the one or more spools. In general, utilizing multiple cables attached to various points of the ride vehicle or the motion base platform may improve a stability of the ride vehicle and improve control of lifting and lowering the ride vehicle. Other actuation mechanisms for actuating the cable are also possible.

The heave system of the overhung ride assembly may also include a strong arm assembly that extends between the transport platform and the ride vehicle (or the motion base platform) and assists in lifting and lowering the ride vehicle relative to the transport platform. The present disclosure may refer to an embodiment of the strong arm assembly as forming a backhoe configuration, as the strong arm assembly may resemble excavating equipment or machinery referred to as a backhoe. The strong arm assembly may include multiple rigid arms connected by hinges that enable certain of the rigid arms to rotate. The present disclosure may describe the rigid arms of the strong arm assembly as being rigid to denote a material strength and geometry of each rigid arm of the strong arm assembly. While the strong arm assembly is configured to move, and while rigid arms of the strong arm assembly may move (e.g., rotate) relative to each other, each rigid arm of the strong arm assembly includes a material and geometric configuration that prevents a portion of the rigid arm of the strong arm assembly from flexing relative to another portion of the rigid arm of the strong arm assembly. For example, in contrast with the cable of the winch assembly, which is configured to flex as it is wound onto (and unwound from) the spool of the winch assembly, the rigid arms of the strong arm assembly are configured to maintain a structural rigidity as they move in accordance with the description above. One of ordinary skill in the art would understand that the rigid arms of the strong arm assembly may not be perfectly rigid, but that the term rigid is used in accordance with the present disclosure to differentiate from substantially less rigid members, such as the cable configured to wind about (and unwind from) the spool of the winch assembly.

The strong arm assembly may include a first rigid arm having a proximal end connected to the ride vehicle (or to the motion base platform) at a first passive hinge. The strong arm assembly may also include a second rigid arm having a proximal end connected to the transport platform at a transport hinge, where the transport hinge is actuated via one or more motors (e.g., the above-described motor[s] configured to drive rotation of the spool[s]) to impart movement to the strong arm assembly. A distal end of the first rigid arm and a distal end of the second rigid arm may be coupled together via a second passive hinge that enables the first rigid arm and the second rigid arm to form a variable angle, where the variable angle between the first rigid arm and the second rigid arm changes as the strong arm assembly is used to lift and/or lower the ride vehicle relative to the transport platform. The first passive hinge and the second passive hinge may be referred to by the present disclosure as being passive to denote that they may not be motor or power driven, whereas the transport hinge may be driven by the one or more motors described above. The first passive hinge between the first rigid arm and the ride vehicle (or motion base platform), the transport hinge between the second rigid arm and the transport platform, and the second passive hinge between the first rigid arm and the second rigid arm may be referred to by the present disclosure as a three-hinge design of the strong arm assembly.

A stabilizing boom connected to the transport platform and coupled to the first rigid arm may support a weight of the assembly and/or facilitate controlled rotation of the first rigid arm about an axis of the second passive hinge between the first rigid arm and the second rigid arm. For example, the stabilizing boom may provide a level of resistance against the first rigid arm and prevent the first rigid arm from freely rotating about an axis of the second passive hinge, such that the first rigid arm only rotates about the axis of the second passive hinge in response to the second rigid arm being driven into rotation about an axis of the transport hinge. In an embodiment of the present disclosure, the stabilizing boom connected to the first rigid arm may move laterally (e.g., across the transport platform and/or underneath the first rigid arm) as the second rigid arm is driven into rotation about the axis of the transport hinge, thus enabling the first rigid arm to rotate about the axis of the second passive hinge. The variable angle between the distal ends of first rigid arm and the second rigid arm, coupled via the second passive hinge, may be decreased (e.g., made more acute) as the ride vehicle is lifted toward the transport platform. Further, the variable angle between the distal ends of the first rigid arm and the second rigid arm may be increased (e.g., made more obtuse) as the ride vehicle is lowered away from the transport platform.

The proximal end of the second rigid arm of the strong arm assembly, connected to the transport hinge at the transport platform, may be rotated about the axis of the transport hinge in response to the transport hinge being rotated by the one or more motors. For example, the second rigid arm may be rigidly coupled to the transport hinge and, as the transport hinge is turned by the one or more motors, the second rigid arm turns with the transport hinge. Accordingly, to lift the ride vehicle, the transport hinge may be turned by the one or more motors in a first circumferential direction to rotate the second rigid arm about the axis of the transport hinge, which in turn causes rotation of the first rigid arm about an axis of the second passive hinge between the first rigid arm and the second rigid arm. As the ride vehicle is lifted toward the transport platform, the variable angle between the distal end of the first rigid arm and the distal end of the second rigid arm may decrease (e.g., become more acute). Further, to lower the ride vehicle, the transport hinge may be turned by the one or more motors in a second circumferential direction opposite to the first circumferential direction to rotate the second rigid arm about the axis of the transport hinge, which in turn causes rotation of the first rigid arm about the axis of the second passive hinge between the first rigid arm and the second rigid arm. As the ride vehicle is lowered away from the transport platform, the variable angle between the distal end of the first rigid arm and the distal end of the second rigid arm may increase (e.g., become more obtuse). It should be noted that, while the strong arm assembly is used to raise and lower the ride vehicle relative to the transport platform, the strong arm assembly may also impart a certain amount of lateral movement of the ride vehicle as the ride vehicle is raised and lowered relative to the transport platform.

In addition to the above-described winch assembly and strong arm assembly, the heave system may also include a compensation assembly configured to assist in lifting of the ride vehicle toward the transport platform. The compensation assembly may be disposed at or adjacent to the transport platform and may include multiple extendible tubes having corresponding reservoirs that store a gaseous fluid, such as nitrogen. For example, first ends of the extendible tubes may be connected to stationary anchors of the transport platform and second ends of the extendible tubes may be connected to a rotation feature at or adjacent to the transport platform, such as the second rigid arm of the above-described strong arm assembly and/or an extension of the transport hinge. As the strong arm assembly is utilized to lower the ride vehicle, the rotating feature (e.g., the second rigid arm and/or the extension of the transport hinge) may move away from the anchors of the transport platform, pulling the second ends of the extendible tubes away from the first ends of the extendible tubes and causing the extendible tubes to extend in length. For example, in an embodiment of the present disclosure, the second ends of the extendible tubes may include, or be coupled to, plungers extending into the first ends of the extendible tubes. A vacuum may be formed in the first end of each tube and defined at least in part by the plunger.

As the extendible tubes extend in length, the gaseous fluid, such as nitrogen, may move into bodies of the extendible tubes. For example, the above-described plungers may move along the first ends of the extendible tubes to expand a volume inside of the extendible tubes. In an embodiment of the present disclosure, the gaseous fluid may reside in both the reservoirs and the bodies of the extendible tubes as the extendible tubes are extended or in an extended state. The expanded volume may increase a pressure differential between the insides of the extendible tubes and an atmosphere surrounding the extendible tubes, generating a fluid force. The fluid force may tend to force the extendible tubes to contract.

In an embodiment of the present disclosure, the motors corresponding to the transport hinge and/or winch described above may perform work to force the strong arm assembly downwardly and to overcome the fluid force generated by the extendible tubes as the ride vehicle is lowered, and/or to maintain the ride vehicle in a lowered (e.g., extended) position. When the motors are disabled and/or used to raise the ride vehicle toward the transport platform, the fluid force generated by the extendible tubes may cause a contraction of the extendible tubes. As the fluid force is released and the extendible tubes contract, the extendible tubes may exert a force against the second rigid arm and/or the extension of the transport hinge and pull the second rigid arm and/or the extension of the transport hinge back toward the anchors of the transport platform. A pulley assembly between each extendible tube and the second rigid arm and/or the extension transport hinge may be configured to convert between lateral movement of the extendible tube and rotational movement of the second rigid arm and/or the extension of the transport hinge. Thus, the extendible tubes may assist in lifting the ride vehicle toward the transport platform, thereby reducing an amount of work required from the motors that turn the transport hinge and/or the spools of the winches of the heave system during a lifting procedure.

A combination of the one or more winch assemblies, the strong arm assembly, and the compensation assembly, referred to collectively as the heave system, is utilized for lifting and lowering the ride vehicle as described above. The heave system may generally facilitate improved heave control and reduced power consumption needed for heaving the ride vehicle relative to traditional embodiments.

In an embodiment of the present disclosure, the heave system may include a pantograph that does not include the above-described backhoe configuration, such as a jointed mechanical linkage framework having a generally rectangular configuration and extending between the ride vehicle (or the motion base platform) and the transport platform. A winch, winch motor, and cable, as previously described, may be used in lifting the ride vehicle and motion base platform and/or supporting a weight of the ride vehicle and motion base platform, while the pantograph extends and contracts to improve stability of the ride vehicle and/or motion base platform. The winch motor may be coupled to a regenerative drive system. In general, the winch motor performs work to use the cable to lift the ride vehicle as the pantograph is contracted. That is, electrical torque of the winch motor performs work to overcome the gravitational forces of the ride vehicle and other features (e.g., the motion base platform) of the overhung ride assembly. However, lifting of the ride vehicle creates potential energy, which is converted to kinetic energy as the ride vehicle is lowered. As the ride vehicle is lowered, the winch motor may act as a generator in order to regenerate power via the kinetic energy created during lowering of the ride vehicle. Induced currents from the winch motor, which acts as a generator during lowering of the ride vehicle, may be passed through a drive and into a bus rail system generally used to power the winch motor, such that the bus rail system can store the generated power for future use during a future lifting of the ride vehicle or another ride vehicle associated with the ride system. In an embodiment of the present disclosure, the regenerative power features described above in conjunction with the generally rectangular pantograph may be employed with the strong arm assembly having the backhoe configuration.

The above-described features may generally improve an experience of a guest positioned in the ride vehicle through improved movement (e.g., lifting, lowering, rolling, pitching, yawing) of the ride vehicle relative to traditional embodiments. Further, the above-described features may generally reduce a cost of ride system manufacturing (e.g., via reduced number of parts, less expensive parts, simplified configuration) and operation (e.g., via utilization of fluid force in the compensation assembly and/or the power regeneration features of the winch assembly) relative to traditional embodiments. These and other features will be described in detail below with reference to the drawings.

Figure 1:
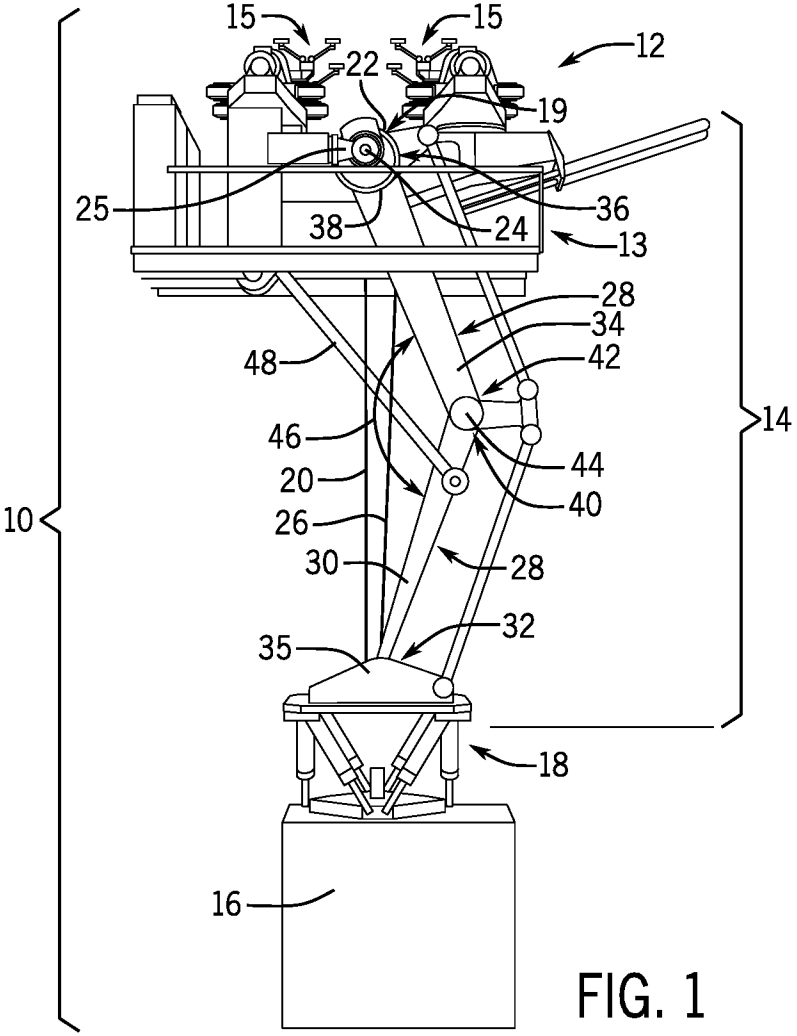
FIG. 1 is a side view of an overhung ride assembly for a ride system, in accordance with an aspect of the present disclosure.

Continuing now with the drawings, FIG. 1 is a side view of an embodiment of an overhung ride assembly 10 for a ride system 12. The ride system 12 may also include a track that is illustrated in later drawings (e.g., FIGS. 2 and 3). The overhung ride assembly 10 may be positioned underneath (or hang from) the track (e.g., while the overhung ride assembly 10 is in a resting or home position). In the embodiment illustrated in FIG. 1, the overhung ride assembly 10 of the ride system 12 includes a transport platform 13 and a heave system 14 configured to lift and lower a ride vehicle 16 of the overhung ride assembly 10 relative to the transport platform 13. The transport platform 13 may be coupled to the track of the ride system 12 via wheel assemblies 15. The heave system 14, as described in detail below, may include several assemblies configured to assist in lifting and lowering of the ride vehicle 16 relative to the transport platform 13. The overhung ride assembly 10 may also include a motion base platform 18 between the heave system 14 and the ride vehicle 16. The motion base platform 18 may include, for example, a Stewart platform or an octopod. In general, the motion base platform 18 may roll, pitch, and/or yaw the ride vehicle 16 relative to the heave system 14 and transport platform 13. In an embodiment, the ride system 12 may not include the motion base platform 18, and features of the heave system 14 may be directly connected to the ride vehicle 16.

As previously described, the heave system 14 may include several assemblies that work in conjunction to lift the ride vehicle 16 toward the transport platform 13 and to lower the ride vehicle 16 away from the transport platform 13. For example, the heave system 14 may include a winch assembly 19 defined at least in part by one or more cables 20 extending from the motion base platform 18 (or directly from the ride vehicle 16) to the transport platform 13. Although only one cable 20 is visible in the side view of the overhung ride assembly 10 in FIG. 1, another cable 20 may be disposed on an opposing side of the overhung ride assembly 10. The one or more cables 20 may be coupled to one or more spools 22 of the winch assembly 19 disposed on the transport platform 13. It should be noted that a single spool 22 for multiple cables 20 may be used, or multiple cable-dedicated spools 22 may be used. For example, while only one spool 22 is visible in the side view of the overhung ride assembly 10 in FIG. 1, another spool 22 may be disposed on an opposing side of the overhung ride assembly 10. The spool 22 in the illustrated embodiment may be turned in a first circumferential direction to unwind the cable 20 from the spool 22 and lower the ride vehicle 16 away from the transport platform 13. The spool 22 may also be turned by a motor 24 in a second circumferential direction opposite to the first circumferential direction to wind the cable 20 onto the spool 22 and raise the ride vehicle 16 toward the transport platform 13. While a collapsible pole 26 is shown in the illustrated embodiment and may be used to stabilize undesirable movement (e.g., undesirable rolling movement) of the ride vehicle 16, the collapsible pole 26 may not be considered a part of the winch assembly 19 noted above.

The heave system 14 of the overhung ride assembly 10 may also include a strong arm assembly 28 that extends between the transport platform 13 and the ride vehicle 16, where the strong arm assembly 28 forms a backhoe configuration. An embodiment of the strong arm assembly 28 may be described as forming a backhoe configuration because it may resemble excavating equipment or machinery referred to as a backhoe. The strong arm assembly 28 may also assist in lifting and lowering the ride vehicle 16 relative to the transport platform 13. It should be noted that the strong arm assembly 28, as described in detail below, may include multiple rigid arms connected by hinges that enable certain of the rigid arms to rotate about the hinges, and that "rigid" is used herein to refer to a material strength and geometry of each rigid arm of the strong arm assembly 28. That is, while the strong arm assembly 28 is configured to move, each rigid arm of the strong arm assembly 28 includes a material and geometric configuration that prevents a portion of the rigid arm from flexing relative to another portion of the rigid arm.

Figure 6:
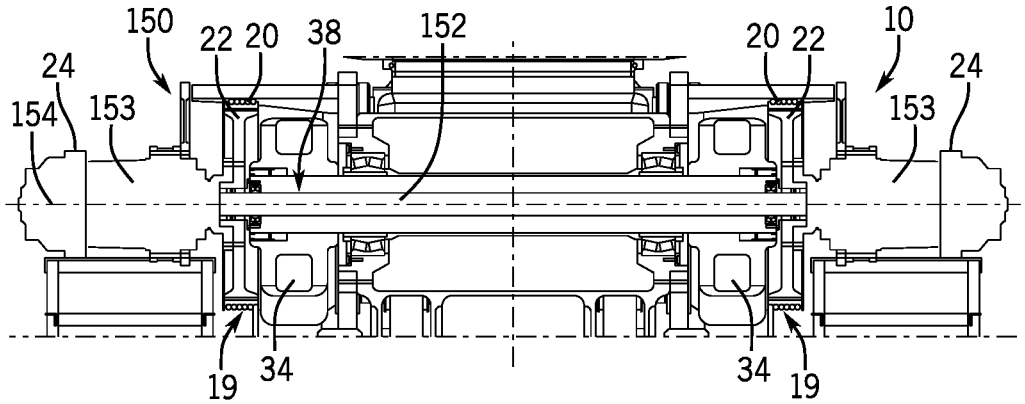
FIG. 6 is a cross-sectional view of a power assembly for a strong arm assembly and winch assembly of the overhung ride assembly of FIG. 1, in accordance with an aspect of the present disclosure.

For example, the strong arm assembly 28 may include a first rigid arm 30 having a proximal end 32 connected to the motion base platform 18 at a first passive hinge 35. That is, the proximal end 32 of the first rigid arm 30 is proximal to the motion base platform 18. However, the proximal end 32 may alternatively be coupled to the ride vehicle 16 via the passive hinge 35, such that the proximal end 32 is proximal to the ride vehicle 16. The strong arm assembly 28 may also include a second rigid arm 34 having a proximal end 36 connected to the transport platform 13 at a transport hinge 38, where the transport hinge 38 is actuated (e.g., via the motor 24 or a separate motor) to impart movement to the strong arm assembly 28. That is, the proximal end 36 of the second rigid arm 34 is proximal to the transport platform 13. The transport hinge 38 of the strong arm assembly 28 and the spool 22 are aligned on an axis in the illustrated embodiment and driven by the motor 24, although the transport hinge 38 and the spool 22 may not be aligned in an embodiment of the present disclosure. Alignment of the transport hinge 38 and the spool 22 is more clearly illustrated, and later described with respect to, FIG. 6. A distal end 40 of the first rigid arm 30 and a distal end 42 of the second rigid arm 34 may be coupled via a second passive hinge 44 that enables the first rigid arm 30 and the second rigid arm 34 to form a variable angle 46. The first passive hinge 35, the transport hinge 38, and the second passive hinge 44 may be referred to herein as a three-hinge design of the strong arm assembly 28. It should be noted that the first passive hinge 35 and the second passive hinge 44 may be described as being passive to denote that they are not power driven in an embodiment of the present disclosure, whereas the transport hinge 38 is power driven (e.g., by the motor 24 or a separate motor) as described in detail below.

A stabilizing boom 48 connected to the transport platform 13 and coupled to the first rigid arm 30 may facilitate controlled rotation of the first rigid arm 30 about an axis of the second passive hinge 44 between the first rigid arm 30 and the second rigid arm 34. For example, the stabilizing boom 48 may provide resistance against the first rigid arm 30 and prevent the first rigid arm 30 from rotating about an axis of the second passive hinge 44, unless the second rigid arm 34 is driven into rotation about an axis of the transport hinge 38. In an embodiment of the present disclosure, the stabilizing boom 48 may move laterally (e.g., across the transport platform 13) as the second rigid arm 34 is driven into rotation about the axis of the transport hinge 38, thus enabling the first rigid arm 30 to rotate about the axis of the second passive hinge 44. Accordingly, the variable angle 46 between the distal ends 40, 42 of first rigid arm 30 and the second rigid arm 34, coupled via the second passive hinge 44, may be decreased (e.g., made more acute) as the ride vehicle 16 is lifted toward the transport platform 13. Further, the variable angle 46 between the distal ends 40, 42 of the first rigid arm 30 and the second rigid arm 34 may be increased (e.g., made more obtuse) as the ride vehicle 16 is lowered away from the transport platform 13.

While the stabilizing boom 48 may provide resistance against free rotation of the first rigid arm 30 about the axis of the second passive hinge 44, other resistance (e.g., frictional resistance) may also be included to block free rotation of the first rigid arm 30 about the second passive hinge 44 and/or about the first passive hinge 35. The above-described configuration of the strong arm assembly 28, which may employ the first rigid arm 30, the second rigid arm 34, and the three-hinge design including the first passive hinge 35, the transport hinge 38, and the second passive hinge 44, may be generally referred to by the present disclosure as a backhoe configuration, as previously described. Power features that impart movement to the strong arm assembly 28 are described in detail below.

The proximal end 36 of the second rigid arm 34 of the strong arm assembly 28, connected to the transport hinge 38 at the transport platform 13, may be rotated about an axis of the transport hinge 38 in response to the transport hinge 38 being rotated by the one or more motors 24 previously described with respect to the one or more spools 22 (or via one or more separate motors). For example, the second rigid arm 34 may be rigidly coupled to the transport hinge 38 and, as the transport hinge 38 is turned by the one or more motors 24, the second rigid arm 34 may turn with the transport hinge 38. Accordingly, to lift the ride vehicle 16 toward the transport platform 13, the transport hinge 38 may be turned by the one or more motors 24 in a first circumferential direction to rotate the second rigid arm 34 about the axis of the transport hinge 38, which in turn causes movement of the first rigid arm 30 about an axis of the second passive hinge 44 between the first rigid arm 30 and the second rigid arm 34. As the ride vehicle 16 is lifted toward the transport platform 13 (e.g., referred to herein as a contracted movement or condition), the variable angle 46 between the distal end 40 of the first rigid arm 30 and the distal end 42 of the second rigid arm 34 may decrease (e.g., become more acute). Further, to lower the ride vehicle 16, the transport hinge 38 may be turned by the one or more motors 24 in a second circumferential direction opposite to the first circumferential direction to rotate the second rigid arm 34 about the axis of the transport hinge 38, which in turn causes movement of the first rigid arm 30 about the axis of the second passive hinge 44 between the first rigid arm 30 and the second rigid arm 34. As the ride vehicle 16 is lowered away from the transport platform 13 (e.g., referred to herein as an extended movement or condition), the variable angle 46 between the distal end 40 of the first rigid arm 30 and the distal end 42 of the second rigid arm 34 may increase (e.g., become more obtuse). It should be noted that, while the strong arm assembly 28 may be used to raise and lower the ride vehicle 16 relative to the transport platform 13 as described above, the strong arm assembly 28 may also impart a certain amount of lateral or horizontal movement of the ride vehicle 16 as the ride vehicle 16 is raised and lowered relative to the transport platform 13. Additional features of the strong arm assembly 28 and a compensation assembly of the heave system 14 will be described in detail below with reference to FIG. 2.

Figure 2:
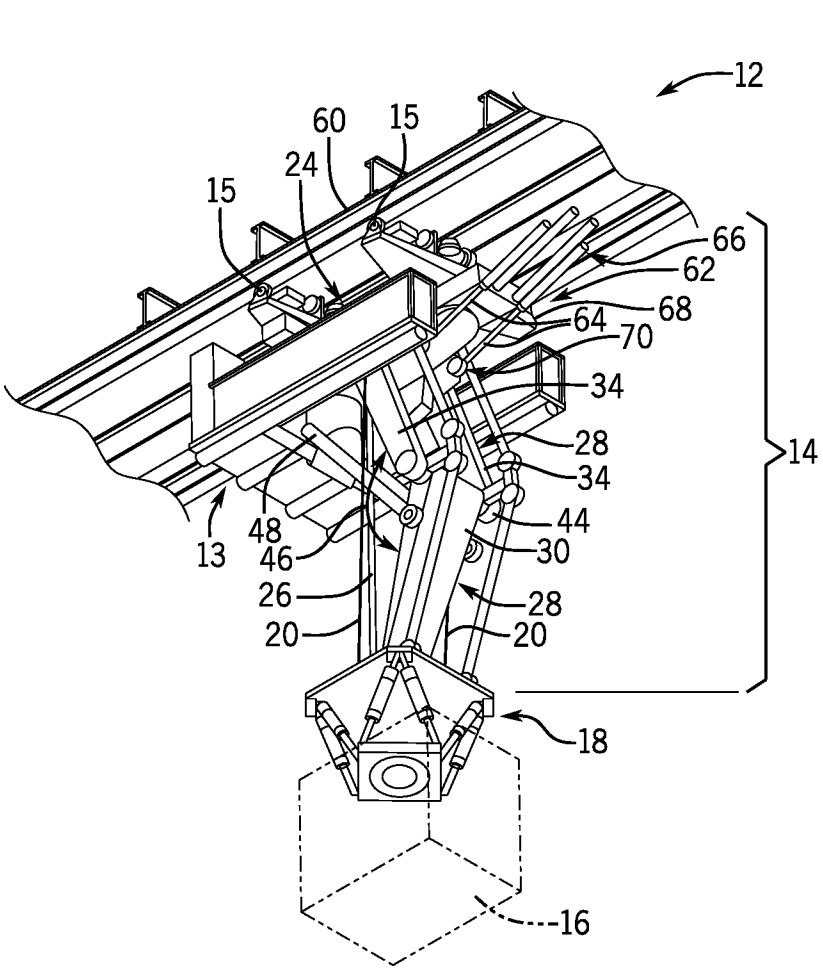
FIG. 2 is a perspective view of a ride system having the overhung ride assembly of FIG. 1, in accordance with an aspect of the present disclosure.

FIG. 2 is a perspective view of an embodiment of the ride system 12 having the overhung ride assembly 10 of FIG. 1. In the illustrated embodiment, the transport platform 13 of the overhung ride assembly 10 is coupled to a track 60 via the wheel assemblies 15, which enable movement of the transport platform 13 along the track 60. The strong arm assembly 28 in the illustrated embodiment includes two separate segments of the second rigid arm 34. For example, the two separate segments of the second rigid arm 34 extend to either side of the passive hinge 44 between the first rigid arm 30 and the second rigid arm 34, and the first rigid arm 30 extends to a middle of the passive hinge 44. The two separate segments of the second rigid arm 34 may be rigidly coupled to the passive hinge 44, and the first rigid arm 30 may be rotatably coupled to the passive hinge 44, enabling a change to the variable angle 46 between the first rigid arm 30 and the second rigid arm 34 as the ride vehicle 16 is lifted or lowered. Alternatively, the two separate segments of the second rigid arm 34 may be rotatably coupled to the passive hinge 44, with the first rigid arm 30 being rigidly coupled to the passive hinge 44. The stabilizing boom 48 extends underneath the first rigid arm 30 and supports the first rigid arm 30 to enable the above-described rotation (e.g., to support a weight of the first rigid arm 30) and prevent the first rigid arm 30 from freely rotating about the second passive hinge 44 when the second rigid arm 34 is not actuated into rotation.

The heave system 14 may also include a compensation assembly 62 used to assist in lifting of the ride vehicle 16 toward the transport platform 13. The compensation assembly 62 may be disposed at or adjacent to the transport platform 13, and may include multiple extendible tubes 64 having corresponding reservoirs that store a gaseous fluid, such as nitrogen. Aspects of the extendible tubes 64 described herein that are not labeled in FIG. 2 (e.g., the reservoir and a body of each extendible tube 64) are labeled in FIG. 3 and will be described in detail with reference to FIG. 3. Continuing with FIG. 2, first ends 66 of the extendible tubes 64 may be connected to a stationary anchor 68 of the transport platform 13, and second ends 70 of the extendible tubes 64 may be connected to the second rigid arm 34 of the above-described strong arm assembly 28 (or to an extension of the transport hinge 38 labeled in FIG. 1). In an embodiment of the present disclosure, a vacuum may be present or formed within each extendible tube 64. As the strong arm assembly 28 is utilized to lower the ride vehicle 16 away from the transport platform 13, the second rigid arm 34 (and/or the extension of the transport hinge 38 labeled in FIG. 1) may move away from the stationary anchor 68 of the transport platform 13, pulling the second ends 70 of the extendible tubes 64 away from the first ends 66 of the extendible tubes 64, and causing the extendible tubes 64 to extend in length.

As the extendible tubes 64 extend in length, the gaseous fluid, such as nitrogen, may move from the reservoirs of the extendible tubes 64 and into the bodies of the extendible tubes 64. In an embodiment of the present disclosure, the gaseous fluid may reside in both the reservoirs and bodies of the extendible tubes 64 when the extendible tubes 64 are extended. That is, the extendible tubes 64 may include variable volumes that increase when the extendible tubes 64 extend and decrease when the extendible tubes 64 contract. The expanded volume when the extendible tubes 64 are extended may increase a pressure differential between the gaseous fluid, such as nitrogen, within the extendible tubes 64 and an environment or atmosphere surrounding the extendible tubes 64. The pressure differential may generate a fluid force that tends to bias the extendible tubes 64 to contract. While the extendible tubes 64 described above are described in the context of storing a gaseous fluid, such as nitrogen, an embodiment of the present disclosure may include storage of air or a liquid fluid. In an embodiment of the present disclosure, the motor(s) 24 (illustrated more clearly in FIG. 1) perform work to overcome the fluid force generated by the extendible tubes 64 as the ride vehicle 16 is lowered, and/or to maintain the ride vehicle 16 in a lowered position.

When the motors 24 are disabled and/or used to raise the ride vehicle 16, the fluid force generated by the extendible tubes 64 may cause the extendible tubes 64 labeled in FIG. 2 to contract. As the fluid force is released and the extendible tubes 64 contract, the extendible tubes 64 may exert a force against the second rigid arm 34 and pull the second rigid arm 34 back toward the stationary anchor 68 of the transport platform 13. Thus, the extendible tubes 64 may assist in lifting the ride vehicle 16 toward the transport platform 13, thereby reducing an amount of work required from the motors 24. The features of the heave system 14 described above with respect to FIGS. 1 and 2, including the winch assembly 19, the strong arm assembly 28, the motor 24, and the compensation assembly 62, may facilitate controlled lifting and lowering of the ride vehicle 16 relative to the transport platform 13. Additional features of the compensation assembly 62 are described in detail below.

Figure 3:
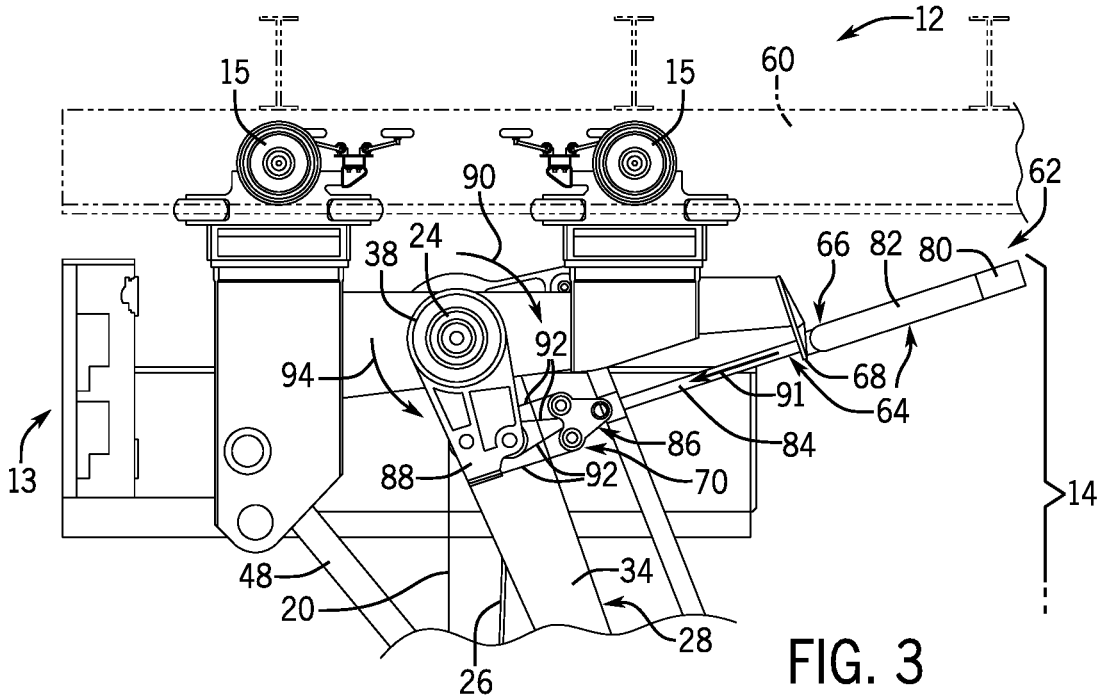
FIG. 3 is a side cross-sectional view of a portion of a ride system having the overhung ride assembly of FIG. 1, in which a ride vehicle of the overhung ride assembly is extended away from a transport platform of the overhung ride assembly, in accordance with an aspect of the present disclosure.
Figure 4:
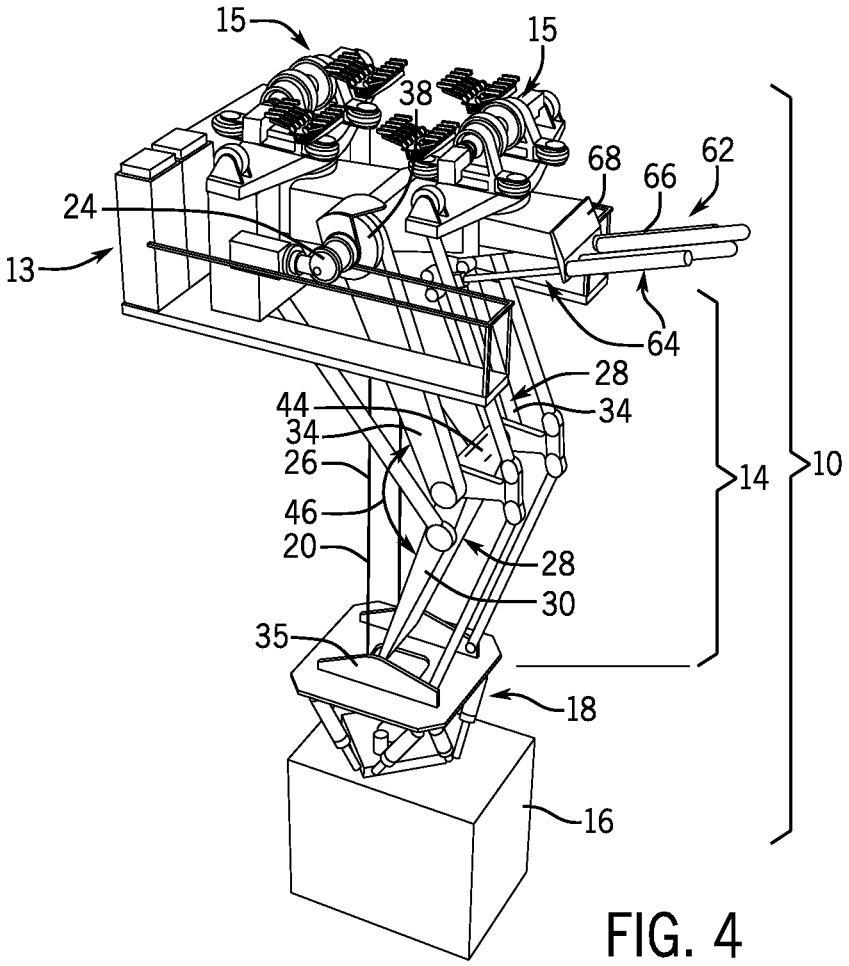
FIG. 4 is a perspective view of the overhung ride assembly of FIG. 1, in which a ride vehicle of the overhung ride assembly is extended away from a transport platform of the overhung ride assembly, in accordance with an aspect of the present disclosure.

FIG. 3 is a side cross-sectional view of an embodiment of a portion of the ride system 12 having the overhung ride assembly 10 of FIG. 1, in which a ride vehicle (not shown in the illustrated embodiment) of the overhung ride assembly 10 is extended away from the transport platform 13 of the overhung ride assembly 10. Although the ride vehicle is not included in the portion of the ride system 12 illustrated in FIG. 3, FIG. 4 is a perspective view of an embodiment of the overhung ride assembly 10 of FIG. 1 in which the ride vehicle 16 of the overhung ride assembly 10 is illustrated and extended away from the transport platform 13 of the overhung ride assembly 10.

Focusing first on FIG. 3, detailed aspects of the compensation assembly 62, described generally above with respect to FIG. 2, are illustrated. In the illustrated embodiment, each extendible tube 64 includes the first end 66 that is coupled to the stationary anchor 68 of the transport platform 13. The first end 66 may include a reservoir 80 and a body 82 of the extendible tube 64, although other configurations of the reservoir 80 and the body 82 are possible. A plunger 84 of the extendible tube 64 may extend into the first end 66 of the extendible tube 64 and may be coupled to an aspect of the strong arm assembly 28 proximate the second end 70 of the extendible tube 64 or an extension 88 of the transport hinge 38. The reservoir 80 and the body 82 may form a sealed chamber. As the transport hinge 38 is rotated in a first circumferential direction 90 by the motor 24 in FIG. 3, the transport hinge 38 may rotate the second rigid arm 34 of the strong arm assembly 28 about an axis of the transport hinge 38, as previously described, to lower the ride vehicle away from the transport platform 13. Further, as the transport hinge 38 is rotated in the first circumferential direction 90 by the motor 24 in FIG. 3, the extension 88 of the transport hinge 38 also rotates and pulls wires 92 of a pulley system 86 of each extendible tube 64.

The pulley system 86 may enable the rotational movement of the transport hinge 38 and/or second rigid arm 34 of the strong arm assembly 28 to cause lateral movement of the plunger 84. For example, the wires 92 of the pulley system 86, in response to rotational movement of the transport hinge 38 in the first circumferential direction 90, may pull the plunger 84 away from (and partially out of) the body 82 of the extendible tube 64 in a lateral direction 91, thereby enabling the gaseous fluid, such as nitrogen, stored in the reservoir 80 of the extendible tube 64 to move into the body 82 of the extendible tube 64. In an embodiment of the present disclosure, the gaseous fluid, such as nitrogen, may reside in both the reservoir 80 and the body 82 of the extendible tube 64 as the plunger 84 is pulled away from (and partially out of) the body 82 of the extendible tube 64. As the gaseous fluid moves into the expanded volume (e.g., the body 82 of the extendible tube 64), fluid pressure or force is generated by the extendible tube 64 (e.g., by way of an increased pressure differential, as previously described). Thus, the motor 24 in FIG. 3 may perform work to force the strong arm assembly 28 downwardly and through the fluid force generated by the extendible tube 64. The motor 24 in FIG. 3 may also perform work to hold the strong arm 28 in place in the lowered or extended state against the fluid force generated by the extendible tube 64.

Figure 5:
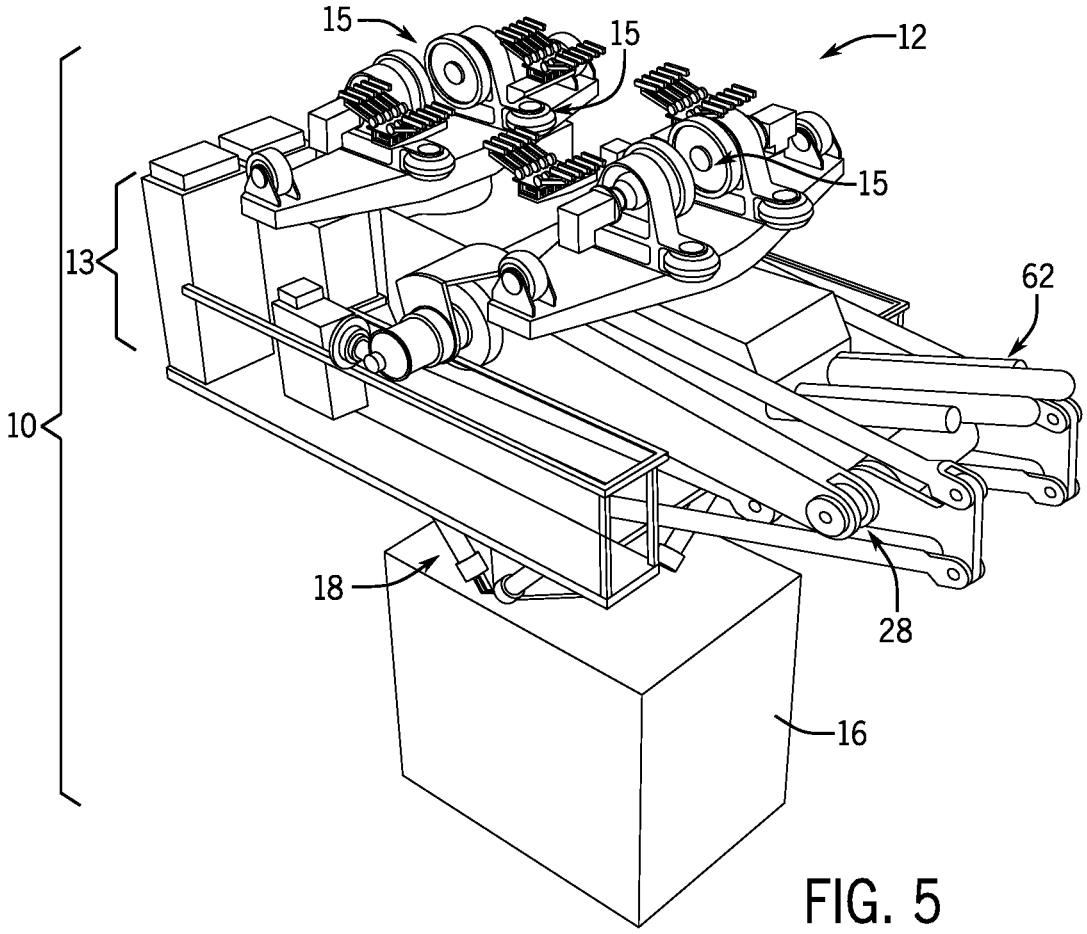
FIG. 5 is a perspective view of the overhung ride assembly of FIG. 1, in which the overhung ride assembly is contracted such that a ride vehicle of the overhung ride assembly is adjacent to a transport platform of the overhung ride assembly, in accordance with an aspect of the present disclosure.

When the motor 24 in FIG. 3 is disabled or used to rotate the transport hinge 38 in a second circumferential direction 94 opposing the first circumferential direction 90 to lift the ride vehicle 16 (illustrated in FIG. 4) toward the transport platform 13, the fluid force generated by the extendible tubes 64 may assist in the lifting of the ride vehicle 16 (illustrated in FIG. 4) toward the transport platform 13. For example, the fluid force generated by the extendible tube 64 may cause the plunger 84 to be retracted back toward and into the body 82 (and toward the reservoir 80) of the extendible tube 64 as the gaseous fluid moves toward the reservoir 80. As previously described, the pulley system 86 may enable the lateral movement of the plunger 84 into the body 82 of the extendible tube 64 to assist the rotational movement of the transport hinge 38 in the second circumferential direction 94. FIG. 5 is a perspective view of an embodiment of the overhung ride assembly 10 of FIG. 1 in a fully contracted condition, in which the overhung ride assembly 10 is contracted such that the ride vehicle 16 of the overhung ride assembly 10 is adjacent the transport platform 13 of the overhung ride assembly 10.

In an effort to clarify certain of the features disposed at the transport platform 13 and described above with respect to FIGS. 1-5, FIG. 6 is a cross-sectional view of an embodiment of a power assembly 150 for the strong arm assembly 28 and winch assembly 19 or assemblies of the overhung ride assembly 10 of FIG. 1. In the illustrated embodiment, two winch assemblies 19 are employed on either side of the power assembly 150. For example, two spools 22 with corresponding cables 20 are employed. A shaft 152 (e.g., of the transport hinge 38) may extend between two motors 24 of the power assembly 150, such that the two motors 24 are configured to turn the shaft 152 of the transport hinge 38 about an axis 154. Gear boxes 153 of the two motors 24 may connect to the shaft 152 to enable the above-described rotation. The second rigid arm 34, which may include two segments as described above, is also coupled to the shaft 152 of the transport hinge 38. Accordingly, the two motors 24 and corresponding gear boxes 153 may be configured to turn the shaft 152 of the transport hinge 38 to drive both the second rigid arm 34 and the spools 22 into rotation for lifting and/or lowering procedures. However, it should be noted that, in an embodiment of the present disclosure, the spools 22 may be driven by separate motors than those corresponding to the second rigid arm 34 of the strong arm assembly 28. Further, in an embodiment of the present disclosure, each spool 22 may be driven by a separate motor.

FIG. 7 is a perspective view of an embodiment of an overhung ride assembly 210 for a ride system 212, where a ride vehicle 216 of the overhung ride assembly 210 is extended away from a transport platform 213 of the overhung ride assembly 210. The ride system 212 also includes a track (not shown), and the overhung ride assembly 210 may be positioned underneath the track when the overhung ride assembly 210 is in a resting or home position. For example, the transport platform 213 of the overhung ride assembly 210 includes wheel assemblies 215 that may be coupled to the track.

In the illustrated embodiment, a pantograph 228 may extend between the transport platform 213 and the ride vehicle 216. A motion base platform 218 may be coupled between the pantograph 228 and the ride vehicle 216, although the pantograph 228 may be coupled directly to the ride vehicle 216. The motion base platform 218 in the illustrated embodiment may be configured to roll, pitch, or yaw the ride vehicle 216 relative to the pantograph 228 and the transport platform 213.

In the illustrated embodiment, a winch assembly 219 may be used to heave the ride vehicle 216 (e.g., lift and lower the ride vehicle 216) relative to the transport platform 213. The winch assembly 219 may include, for example, a cable 220 extending between a spool 222 and the ride vehicle 216 (or the motion base platform 218, or a base 229 of the pantograph 228). The spool 222 may be rotated in a first circumferential direction to wind the cable 220 about the spool 222, which lifts the ride vehicle 216 toward the transport platform 213. The spool 222 may also rotate in a second circumferential direction opposite to the first circumferential direction to unwind the cable 220 from the spool 222, which lowers the ride vehicle 216 away from the transport platform 213. During lifting of the ride vehicle 216, the pantograph 228, which includes a jointed mechanical linkage framework, may contract to enable the ride vehicle 216 to move toward the transport platform 213. During lowering of the ride vehicle 216, the pantograph 228 may extend to enable the ride vehicle 216 to move away from the transport platform 213. The spool 222 of the winch assembly 219 may be driven by a motor 224 and corresponding gear box 225. While FIG. 7 illustrates the overhung ride assembly 210 with the ride vehicle 216 extended away from the transport platform 213, FIG. 8 is a perspective view of an embodiment of the overhung ride assembly 210 of FIG. 7, in which the overhung ride assembly 210 is contracted such that a ride vehicle (not shown in FIG. 8) of the overhung ride assembly 210 is adjacent to the transport platform 213 of the overhung ride assembly 210 and the pantograph 228 is in a contracted state.

FIG. 9 is a perspective view of an embodiment of the winch assembly 219 for use in the overhung ride assembly 210 of FIG. 7, the winch assembly 219 being configured to lift the ride vehicle 216 of the overhung ride assembly 210 of FIG. 7 and to generate power as the ride vehicle 216 is lowered. For example, as previously described, the winch assembly 219 includes the spool 222, the cable 220 wrapped about an axis 221 of the spool 222, the gear box 225, and the motor 224 configured to drive rotation of the spool 222 via the gear box 225. The motor 224 and corresponding gear box 225 may drive rotation of the spool 222 in a first circumferential direction 230 to wrap the wind the cable 220 about the spool 222. The spool 222 may also rotate in a second circumferential direction 232 opposite to the first circumferential direction 230 to unwind the cable 220 from the spool 222. When the cable 220 is wound about the spool 222 (e.g., to lift the ride vehicle 216 illustrated in FIG. 7), the motor 224 may perform work. However, when the cable 220 is unwound from the spool 222, a potential energy generated by an elevated position of the ride vehicle 216 illustrated in FIG. 7 is converted to kinetic energy as the ride vehicle 216 illustrated in FIG. 7 is lowered.

For example, the motor 224 may act as a generator in order to regenerate power via the kinetic energy created during lowering of the ride vehicle 216 illustrated in FIG. 7. Induced currents in the motor 224, which acts as a generator, may be passed through a drive 250 and into a bus rail system 252 generally used to power the motor 224, such that the bus rail system 252 can store the generated power for future use during a future lifting of the ride vehicle 216 illustrated in FIG. 7 or another ride vehicle associated with the system. In an embodiment of the present disclosure, the regenerative power features described above in conjunction with the generally rectangular pantograph 228 illustrated in FIGS. 7 and 8 may be employed with the strong arm assembly 28 illustrated in FIGS. 1-6 and having the backhoe configuration.

Technical benefits of embodiments of the present disclosure include reducing a cost of ride system manufacturing (e.g., via reduced number of parts, less expensive parts, simplified configuration) and operation (e.g., via utilization of fluid force generated by the compensation assembly and/or the power regeneration features of the winch assembly) relative to traditional embodiments. Further, technical benefits of embodiments of the present disclosure include improved motion control (e.g., enhanced motion and improved motion stability) of a ride vehicle, thereby improving a guest experience of a guest positioned in the ride vehicle.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a track; and an overhung ride assembly, wherein the overhung ride assembly comprises:

a transport platform coupled to the track;

a ride vehicle; and a heave system extending between the transport platform and the ride vehicle and configured to heave the ride vehicle relative to the transport platform, wherein the heave system comprises an extendible tube defining a variable volume configured to store a gaseous fluid, and wherein the extendible tube is configured to extend in response to a lowering of the ride vehicle away from the transport platform by the heave system such that the gaseous fluid within the variable volume of the extendible tube enables a fluid force that biases the extendible tube toward a contracted configuration to assist the heave system with a lifting of the ride vehicle toward the transport platform.

2. The ride system of claim 1, wherein the extendible tube comprises:

a reservoir configured to store the gaseous fluid; and a body fluidly coupled to the reservoir and configured to receive the gaseous fluid from the reservoir as the extendible tube is extended in response to the lowering of the ride vehicle away from the transport platform.

3. The ride system of claim 2, wherein the extendible tube comprises a plunger extending into the body of the extendible tube and configured to move away from and partially out of the body of the extendible tube in response to the lowering of the ride vehicle away from the transport platform.

4. The ride system of claim 1, wherein the heave system of the overhung ride assembly comprises a strong arm assembly extending between the transport platform and the ride vehicle.

5. The ride system of claim 4, comprising a motor configured to force actuation of the strong arm assembly against resistance caused by the fluid force enabled by the gaseous fluid within the variable volume of the extendible tube.

6. The ride system of claim 4, wherein the strong arm assembly comprises:

a first rigid arm coupled, via a first passive hinge, to the ride vehicle or a motion base platform between the strong arm assembly and the ride vehicle; and a second rigid arm coupled to the transport platform via a transport hinge and to the first rigid arm via a second passive hinge, wherein the second passive hinge enables an angle formed by the first rigid arm and the second rigid arm to change in response to the lifting of the ride vehicle toward to the transport platform and the lowering of the ride vehicle away from the transport platform.

7. The ride system of claim 6, comprising a motor configured to:

turn the transport hinge in a first circumferential direction to drive the second rigid arm into a first rotation that causes the lowering of the ride vehicle away from the transport platform; and turn the transport hinge in a second circumferential direction to drive the second rigid arm into a second rotation that causes the lifting of the ride vehicle toward the transport platform.

8. The ride system of claim 1, comprising a motion base platform disposed between the ride vehicle and the heave system, wherein the motion base platform is configured to roll, pitch, and/or yaw the ride vehicle relative to the strong arm assembly.

9. The ride system of claim 8, wherein the motion base platform comprises an octopod or a Stewart platform.

10. The ride system of claim 1, wherein the heave system comprises a winch assembly, the winch assembly comprising:

a spool;

a cable coupled to the spool and to the ride vehicle or a motion base platform between the ride vehicle and the cable, wherein the spool is configured to turn in a first circumferential direction to wind the cable about the spool to cause the lifting of the ride vehicle toward the transport platform, and to turn in a second circumferential direction opposite to the first circumferential direction to unwind the cable from the spool to cause the lowering of the ride vehicle away from the transport platform; and a motor configured to drive the spool into rotation in at least the first circumferential direction.

11. A ride system, comprising:

a track; and an overhung ride assembly, wherein the overhung ride assembly comprises:

a transport platform coupled to the track;

a ride vehicle; and a heave system extending between the transport platform and the ride vehicle and configured to heave the ride vehicle relative to the transport platform, wherein the heave system comprises a strong arm assembly having a backhoe configuration including a first rigid arm coupled via a first hinge to the ride vehicle or to a motion base platform coupled to the ride vehicle, and including a second rigid arm coupled the first rigid arm via a second hinge and to a transport hinge at the transport platform.

12. The ride system of claim 11, comprising a motor configured to drive the transport hinge into rotation such that the second rigid arm rotates about a first axis of the transport hinge and the first rigid arm rotates about a second axis of the second hinge.

13. The ride system of claim 12, comprising an additional motor configured to drive the transport hinge into rotation such that the second rigid arm rotates about the first axis of the transport hinge and the first rigid arm rotates about the second axis of the second hinge, wherein the motor and the additional motor are disposed on opposing sides of a shaft of the transport hinge.

14. The ride system of claim 13, wherein the second rigid arm comprises a first arm segment and a second arm segment disposed on the opposing sides of the shaft of the transport hinge.

15. The ride system of claim 11, comprising a stabilizing boom extending from the transport platform to the first rigid arm, wherein the stabilizing boom is configured to:

block rotation of the first rigid arm about an axis of the second hinge in response to the second rigid arm being stationary; and enable rotation of the first rigid arm about the axis of the second hinge in response to rotation of the second rigid arm about an additional axis of the transport hinge.

16. The ride system of claim 11, wherein the heave system comprises a winch assembly having a spool disposed at the transport platform and a cable extending between the spool and the ride vehicle or the motion base platform coupled to the ride vehicle.

17. The ride system of claim 16, wherein the heave system comprises a motor configured to drive rotation of the transport hinge of the strong arm assembly and the spool of the winch assembly.

18. A ride system, comprising:

a track; and an overhung ride assembly, wherein the overhung ride assembly comprises:

a transport platform coupled to the track;

a ride vehicle; and a heave system configured to heave the ride vehicle relative to the transport platform, wherein the heave system comprises a winch assembly having a spool, a cable coupled to the spool, and a motor configured to:

drive the spool into rotation in a first circumferential direction to lift the ride vehicle via the cable toward the transport platform and create potential energy in the ride vehicle; and generate power via induced currents in the motor in response to the spool rotating in a second circumferential direction opposite to the first circumferential direction as the ride vehicle is lowered via the cable away from the transport platform and the potential energy of the ride vehicle is converted to kinetic energy, the induced currents being directed to a drive corresponding to the motor and to a bus rail system coupled to the drive.

19. The ride system of claim 18, comprising:

a motion base platform coupled to the ride vehicle and configured to roll, pitch, and/or yaw the ride vehicle relative to the heave system; and a pantograph coupled to the transport platform and the motion base platform, wherein the pantograph comprises a jointed mechanical linkage framework configured to contract as the ride vehicle is lifted toward the transport platform and extend as the ride vehicle is lowered away from the transport platform.

20. A ride system, comprising:

a track; and an overhung ride assembly, wherein the overhung ride assembly comprises:

a transport platform coupled to the track;

a ride vehicle;

a heave system configured to heave the ride vehicle relative to the transport platform, wherein the heave system comprises a winch assembly having a spool, a cable coupled to the spool, and a motor configured to:

drive the spool into rotation in a first circumferential direction to lift the ride vehicle via the cable toward the transport platform and create potential energy in the ride vehicle; and generate power in response to the spool rotating in a second circumferential direction opposite to the first circumferential direction as the ride vehicle is lowered via the cable away from the transport platform and the potential energy of the ride vehicle is converted to kinetic energy;

a motion base platform coupled to the ride vehicle and configured to roll, pitch, and/or yaw the ride vehicle relative to the heave system; and a pantograph coupled to the transport platform and the motion base platform, wherein the pantograph comprises a jointed mechanical linkage framework configured to contract as the ride vehicle is lifted toward the transport platform and extend as the ride vehicle is lowered away from the transport platform.

* * * * *